United States Patent [19]

Sergeant

[11] 4,160,317

[45] Jul. 10, 1979

[54] APPLICATOR TOOL WITH MULTIPLE CHAMBER MAGAZINE

[75] Inventor: Ronald G. Sergeant, Winston-Salem, N.C.

[73] Assignee: AMP Incorporated, Harrisburg, Pa.

[21] Appl. No.: 939,515

[22] Filed: Sep. 5, 1978

[51] Int. Cl.[2] ..... H01R 43/04

[52] U.S. Cl. ..... 29/749; 29/751; 29/759; 29/816

[58] Field of Search ..... 29/749, 747, 751, 753, 29/758, 759, 811, 816

[56] References Cited

U.S. PATENT DOCUMENTS

| | | | |
|---|---|---|---|
| 3,825,987 | 7/1974 | Smith et al. | 29/752 |
| 4,040,179 | 8/1977 | Sanchez | 29/749 |

*Primary Examiner*—Carl E. Hall
*Attorney, Agent, or Firm*—Gerald K. Kita

[57] ABSTRACT

A tool is disclosed for dispensing connectors from a multiple chamber magazine and for assembling the connectors onto multiple electrical wires. The tool includes a ram which is adjustable in size to accommodate different sized connectors. One handle of the tool incorporates a passageway having multiple walls which align and support each chamber of the magazine. A spring loaded ejector or thrust arm slideably straddles one magazine chamber and enters an open side of the chamber to urge the connectors therein toward a work station of the tool whereat the connectors are engaged by the ram for assembly onto the wires.

5 Claims, 12 Drawing Figures

APPLICATOR TOOL WITH MULTIPLE CHAMBER MAGAZINE

BACKGROUND OF THE INVENTION

A lever actuated tool for closing a connector onto multiple wires advantageously incorporates magazine storage for a plurality of the connectors. A magazine externally of the tool provides capacious storage, but limits maneuverability of the tool. An internal magazine sacrifices storage capacity to allow for tool compactness and portability.

SUMMARY OF THE INVENTION

A tool according to the present invention incorporates an internal multiple chamber magazine which provides a large supply of connectors. Yet the tool remains compact. The multiple chambers of the magazine are individually supported and aligned in a passageway of the tool. An ejector and thrust arm is guided along one of the magazine chambers by straddling a portion of the same. The thrust arm includes a finger which enters the straddled chamber to impell or urge a plurality of connectors axilly along the chamber toward a work station of the tool. The work station is defined in a space between a fixed anvil and a cooperating ram which is reciprocated toward and away from the anvil by pivoting a handle of the tool.

Ram actuation compresses each connector in turn against the anvil, closing the connector over multiple wires which have been properly inserted into the connector by an operator of the tool. Ram actuation additionally lifts the closed connector from engagement with an impediment stop, provided by the tool case, which initially positions each connector in turn at the work station. The thrust arm ejects the lifted connector only if fully closed and urges the remaining connectors forwardly toward the work station until a foremost connector engages the stop. If the closed connector is insufficiently reduced in height, it will not be ejected, indicating insufficient electrical connection to the inserted wires. A portion of the ram is moveable to an offset location so that the size of the ram is changed to accomodate connectors of different sizes.

OBJECTS OF THE INVENTION

An object of the present invention is to provide a lever actuated tool for closing electrical connectors onto multiple electrical wires, the tool having a ram portion moveable to an offset location so that the size of the ram is changed to accommodate connectors of different sizes.

Another object is to provide a lever actuated tool for assembling connectors onto multiple electrical wires, the tool having a multiple chamber magazine for storing and dispensing connectors to a work station of the tool.

Another object of the present invention is to incorporate a multiple chamber magazine internally of a lever actuated tool which dispenses electrical connectors serially in turn to a work station of the tool, whereat a variable size ram accommodates connectors of different sizes for connection to multiple electrical wires.

Another object of the present invention is to incorporate a multiple chamber magazine internally of a lever actuated tool which has a passageway that aligns and supports each chamber of the magazine.

Another object of the present invention is to provide a multiple chamber magazine for incorporation in a lever actuated tool which does not sacrifice maneuverability or portability of the tool.

Another object of the present invention is to provide a portable tool for dispensing electrical connectors from a multiple chamber magazine and for connecting each connector in turn onto multiple electrical wires, the tool including a ram which lifts the connectors from engagement with an impediment stop provided by the tool case, to allow for ejection of the lifted connector, if sufficiently closed to the proper reduced height, and impelling remaining connectors in the magazine forwardly toward a work station of the tool until a foremost connector engages the stop.

Other objects and many attendant advantages of the present invention will become apparent from the following detailed description taken in conjunction with the accompanying drawings.

DETAILED DESCRIPTION

Figure 1:
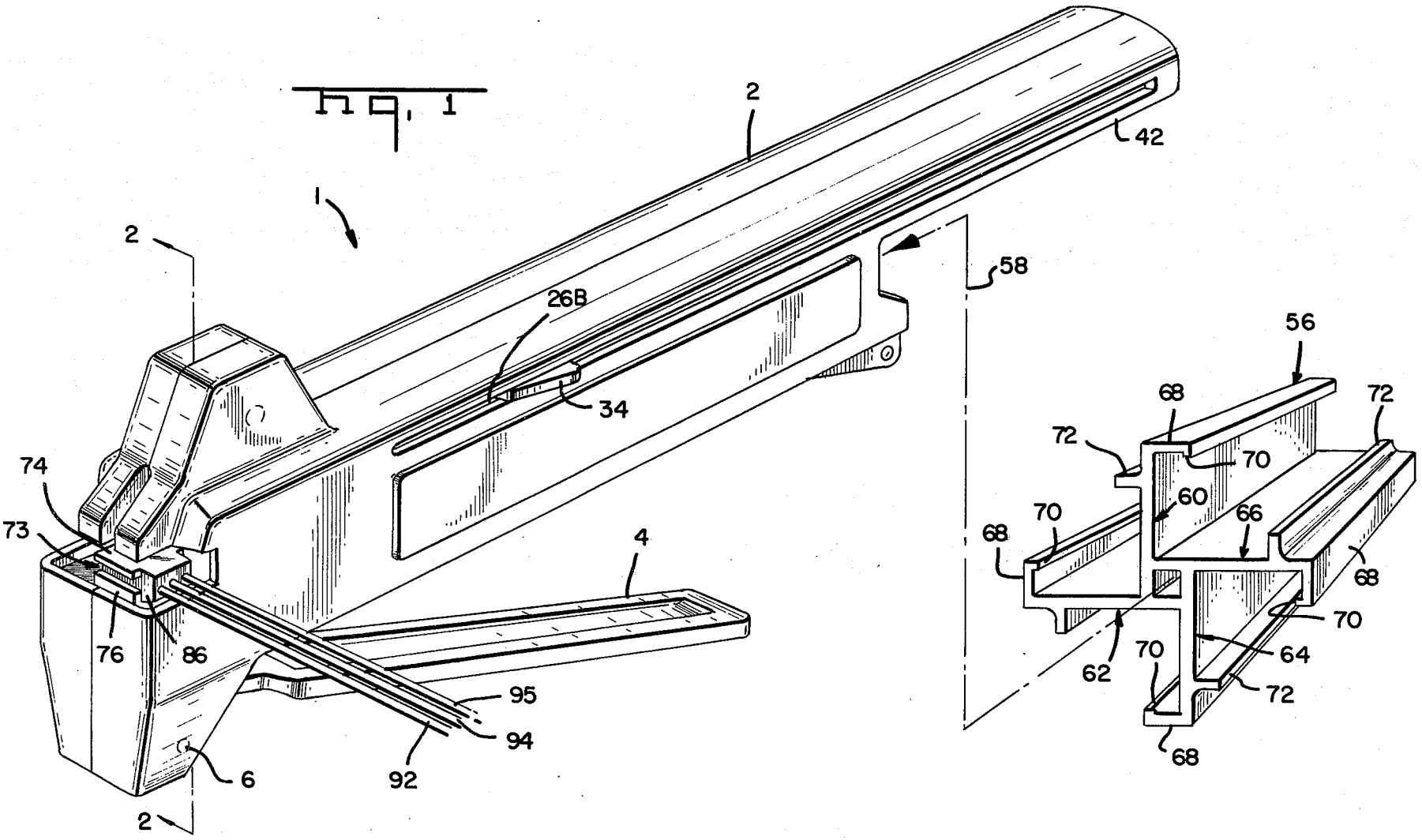
FIG. 1 is a perspective of a tool according to the present invention illustrating an exemplary connector prior to closure thereof onto a plurality of electrical wires, a multiple chamber magazine for the tool being illustrated in exploded configuration.
Figure 2:
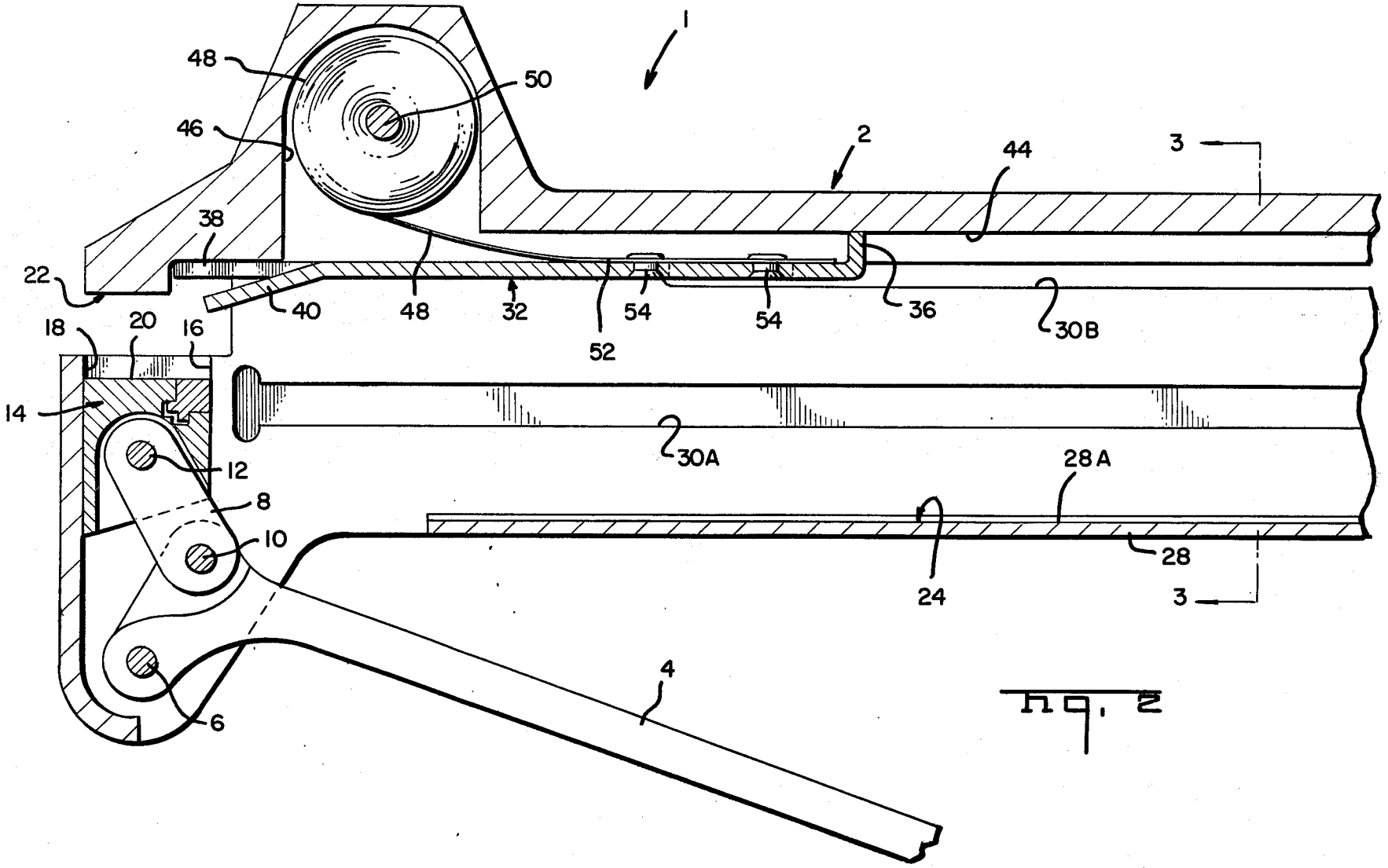
FIG. 2 is an enlarged fragmentary elevation of the tool in section.

With more particular reference to the drawings there is shown in FIG. 1 a tool 1 having a first handle 2 and a second handle 4 pivotally connected by a pin 6 to the handle 2. FIG. 2 illustrates the handle 2 having a generally hollow interior containing the pivoted end of the handle 4 and a link 8, pivotally connected at 10 to the handle 4, and at 12 to a sliding block ram 14 which is slideable in a channel 16 defined immediately adjacent the outer side wall or casing 18 of the handle 2. A planar surface 20 of the ram is in spaced relationship from an inverted planar anvil 22 integral with the handle 2. A work station is defined in the space between the ram 14 and the anvil 22.

Figure 3:
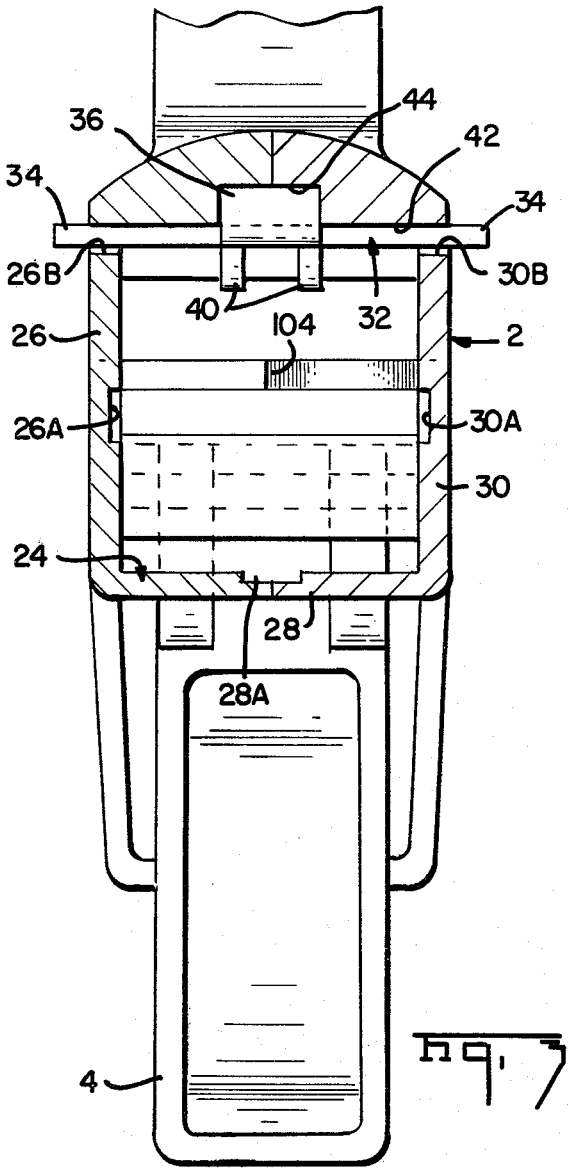
FIG. 3 is an enlarged fragmentary end elevation of the tool in section.
Figure 5:
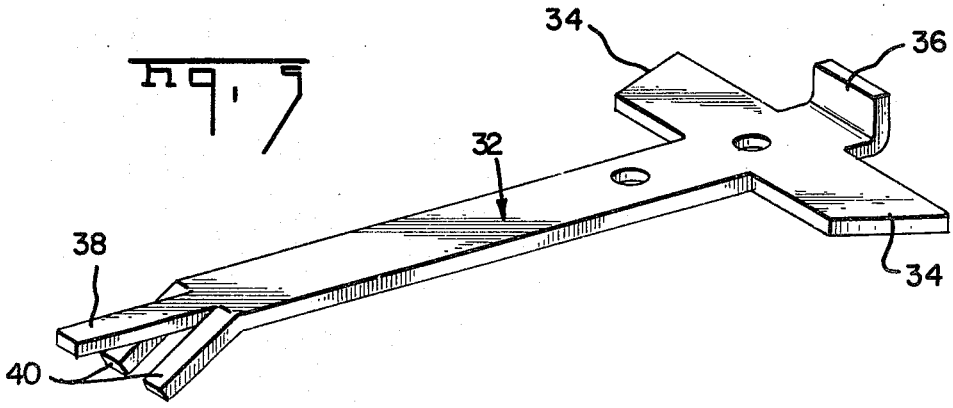
FIG. 5 is an enlarged perspective of an ejector and thrust arm of the tool.

FIGS. 2 and 3 illustrate the elongated handle 2 being provided with an axial passageway 24 having multiple enclosure walls 26, 28, and 30, each provided with an axial groove 26A, 28A, and 30A respectively. FIG. 5 illustrates an elongated ejector and thrust arm 32 generally of metal having coplanar flanges 34 extending in opposite directions. One end of the ejector 32 is bent outwardly of the plane thereof to provide a projecting tab 36. The opposite end is divided into a first coplanar finger 38 flanked by a pair of diagonally depending fingers 40.

FIGS. 2, 3, and 5 more particularly illustrate ejector 32 mounted substantially within the passageway 24 adjacent an inverted top wall 42 of the tool casing. The wall 42 is provided axially thereof with a channel shaped recess or groove 44 which slideably receives the tab 36 of the ejector 32. The flanges 34 project outwardly of the passageway 24 and slideably project through axial slotted openings 26B and 30B in the walls 26 and 30, respectively.

FIG. 2 illustrates thrust arm 32 in its forwardmost position where the finger 38 thereof is stopped against the projecting anvil 22. The tool handle 2 is provided with an inverted chamber 46 communicating with the passageway 24 and containing a negator spring 48 rolled up on a pin 50 mounted in the tool casing. One end 52 of the spring is secured by rivets 54 to the thrust arm 32.

FIG. 1 illustrates that the inverted wall 42 projects axially beyond the remainder of the walls 26, 28, and 30. A multiple chamber magazine is illustrated generally at 56 which may be freely inserted into the passageway as shown by the arrow 58. An operator of the tool first will grasp the flanges 34 which project outwardly of the tool passageway 24, and slideably traverse the same along the slotted openings 26B and 30B, thereby transporting the thrust arm to the projecting part of the upper wall 42, so that magazine 56 may be inserted in the passageway 24 ahead of the thrust arm 32.

Details of the magazine 56 will be explained more particularly in FIGS. 1 and 4. The magazine comprises a plurality of rhombically extending adjacent side walls 60, 62, 64, and 66. As shown each pair of adjacent side walls intersect each other axially of their length. For example, the side wall 60 is intersected on one side thereof by the side wall 66. Additionally, the side wall 60 is intersected along its opposite side thereof by the side wall 62. Accordingly each side wall is intersected on opposite sides by corresponding adjacent side walls. Additionally, each side wall is integral axially along its length thereof with a relatively narrow width end wall 68 intersecting one side of the corresponding side wall and overlying an adjacent side wall which also intersects the same side. For example, the side wall 60 is intersected on the one side thereof by the end wall 68, which is parallel to and in spaced relationship from the side wall 66, which intersects or projects from the same side of the side wall 60. Each end wall 68 further is provided with an integral projecting axial rib 70 which projects toward the opposed parallel side wall.

Each side wall further is intersected on an opposite side thereof by a relatively narrow width wall 72. Each wall 72 extends axially of the intersected corresponding side wall and is parallel to and in spaced relationship from an adjacent side wall which intersects the corresponding side wall on the same side. For example, the side wall 60 is axially integral with the wall 72 which is parallel to the side wall 62, which intersects the side wall 60 on the same side as does the wall 72.

The magazine 56 thereby provides a plurality of article dispensing chambers, with each chamber being defined on two sides by a side wall and its integral end wall, and on two additional sides by an adjacent intersecting side wall and its integral immediate wall. For example, one chamber is defined by the side wall 60 and its integral end wall 69, and further by the intersecting side wall 66 and its intermediate wall 72. The chamber therefore is open along a side thereof defined generally between the end wall 68 and the wall 72.

In similar fashion another chamber is defined by the side wall 62 and its integral intermediate wall 72, and further by the intersecting side wall 72 and its integral end wall 68. Again this additional chamber is open along a side defined generally between the wall 72 of the side wall 60 and the end wall 68 of the side wall 62. In similar fashion, two additional chambers are provided having similar open sides. The four chambers thereby are axially parallel each other and are orbitally spaced about a central axis of the magazine 56.

Figure 10:
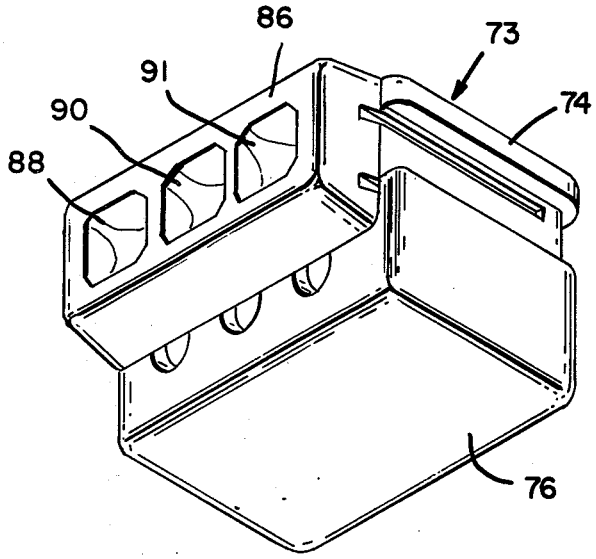
FIG. 10 is an enlarged perspective of a connector upon which the present invention operates.
Figure 11:
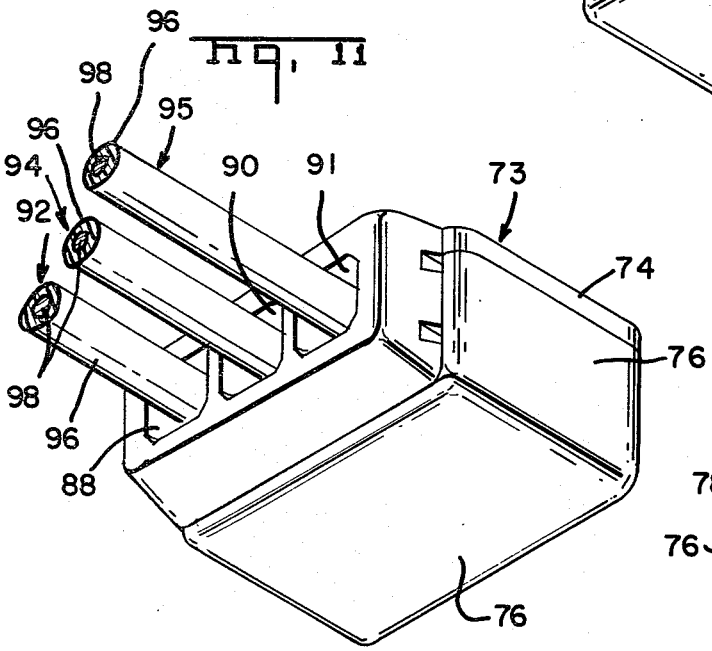
FIG. 11 is a perspective similar to FIG. 10, illustrating closure of the connector on multiple wires.
Figure 12:
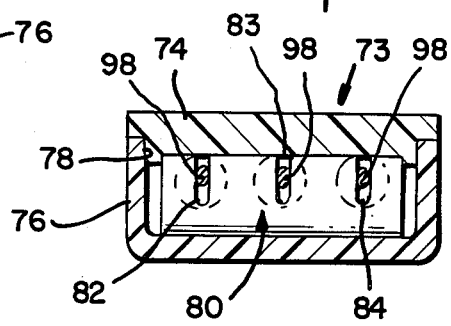
FIG. 12 is a section along line 12—12 of FIG. 11.

The magazine 56 is suitable for containing electrical connectors in serial arrangement. An exemplary connector is shown at 73 in FIGS. 10, 11, and 12 and includes an upper housing portion 74, fabricated from insulative plastics material, and a cooperating second housing portion 76, having an internal cavity 78 which is provided with a metal plate 80 having open ended slots 82, 83, and 84. The housing portion 74 includes an integral projecting, relatively thick end wall 86 having multiple openings therethrough 88, 90, and 91. Initially, individual insulation covered wires 92, 94, and 95 are inserted into the openings 88, 90, and 91. The ends of the wires are thereby in registration within the housing portion 74. Initially the housing portion 76 and the electrical plate contact 80 is in spaced relationship from the housing portion 74 and the wires 92, 94, and 95. The connector is closed over the wires by pressing the housing portins 74 and 76 toward each other until they abut as shown in FIG. 11. The contact slots 82 and 84 then will slice through the insulation 96 of the wires and will wedgingly engage the conductors 98 of the wires, thereby electrically connecting the three wires together.

Figure 9:
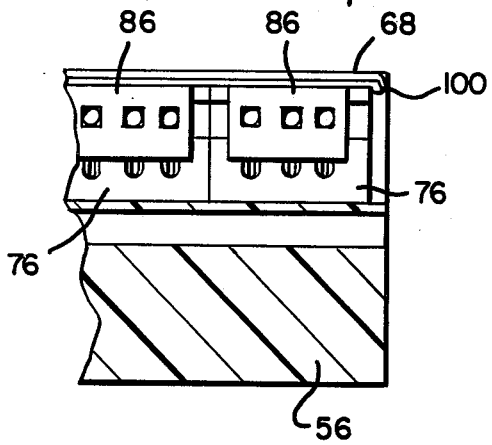
FIG. 9 is a fragmentary enlarged elevation in section illustrating retention of the connectors in a chamber of the magazine.

A plurality of the connectors are serially located within each of the chambers of the magazine 56, with the thickened end wall 86 of each connector projecting through the open side of each chamber. To retain the connectors in place, each of the end walls 68 is swedged to provide a bent over lip as shown at 100 in FIG. 9.

Figure 4:
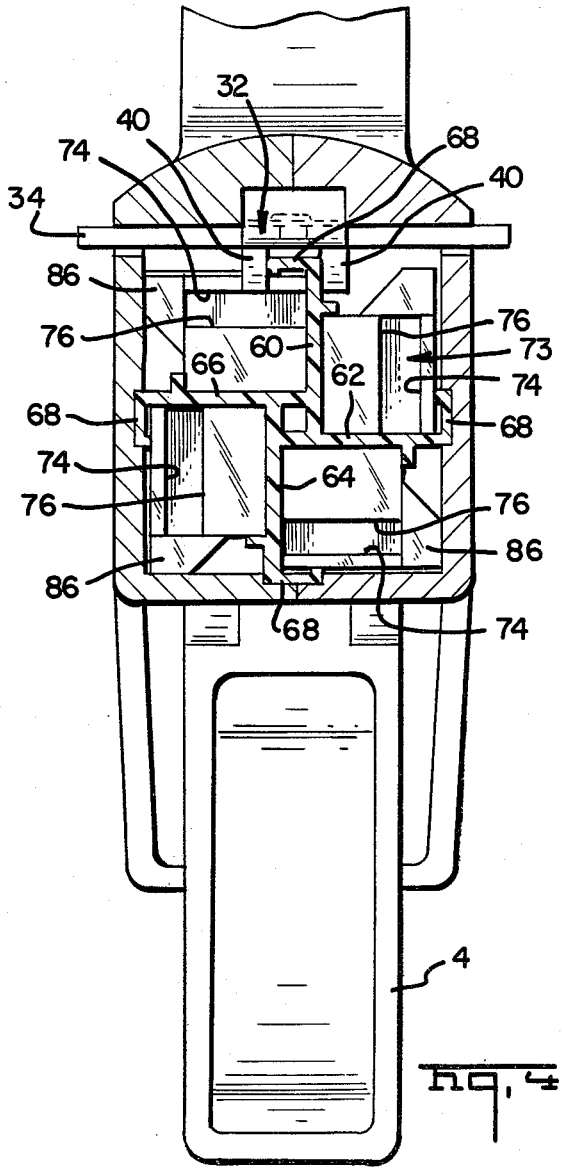
FIG. 4 is a view similar to FIG. 3 illustrating the tool with the magazine inserted therein.
Figure 6:
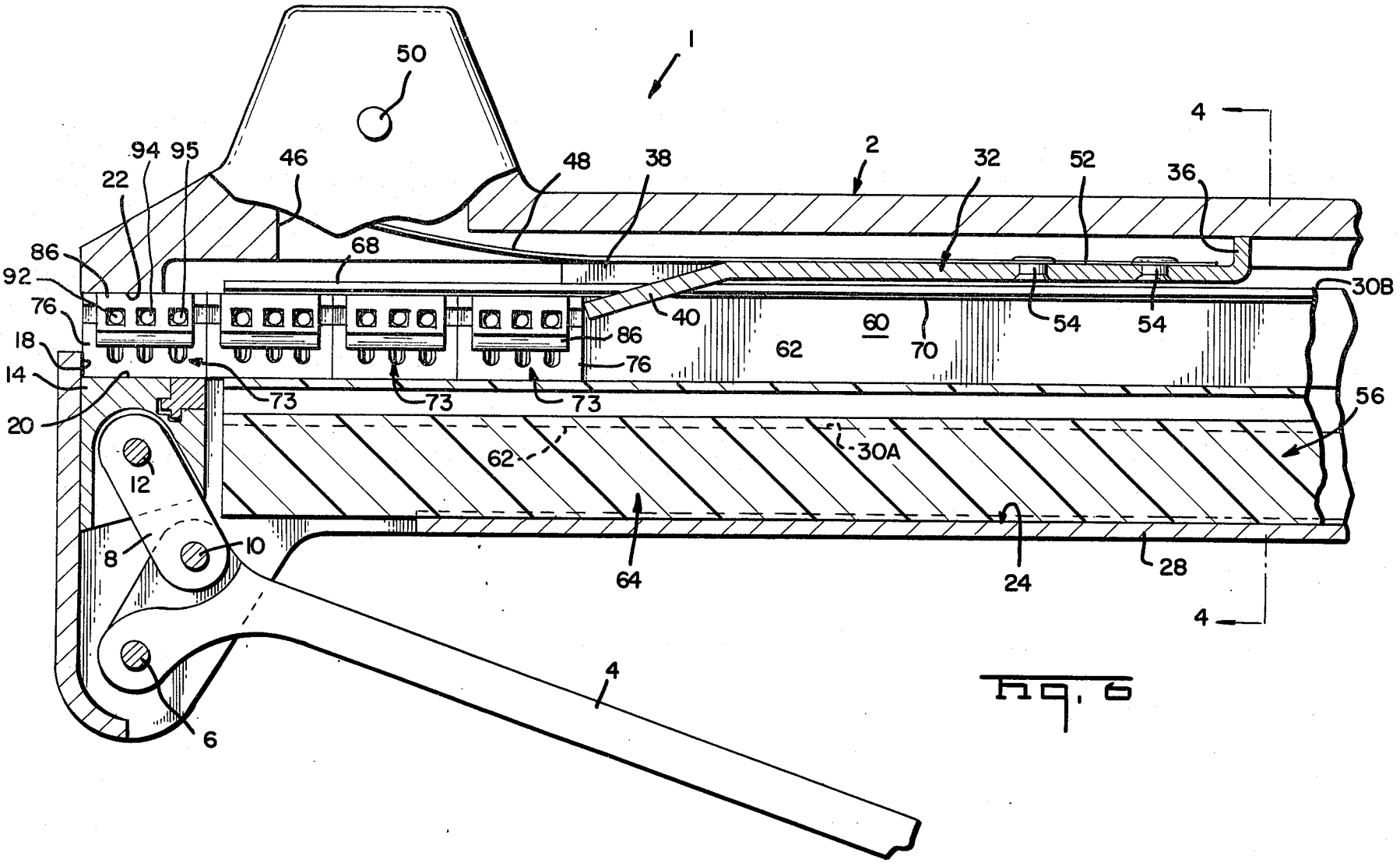
FIG. 6 is a fragmentary enlarged side elevation of the tool illustrating a plurality of serially fed electrical connectors.

When all four chambers of the magazine are fully loaded with connectors, the magazine is inserted into the tool passageway 24 as shown in FIGS. 4 and 6. A first magazine chamber, formed along the intersecting sidewalls 60 and 62, is in alignment with the work station of the tool. The end wall 68 which is integral with the side wall 60 is straddled on either side by the depending fingers 40 of the ejector and thrust arm 32. One of the fingers 40 enters the open side of the corresponding magazine chamber to engage a rearmost one of the connectors 73 contained therein. The finger 38 will overlie a top of the rearmost one of the connectors 73 to prevent inadvertent dropping of the fingers behind the rearmost connector. The negator spring 48 will tend to roll up on itself and provide a resilient, substantially constant force tending to impel the thrust finger toward the work station of the tool, so that the serially arranged connectors 73 are also urged toward the work station.

Figure 7:
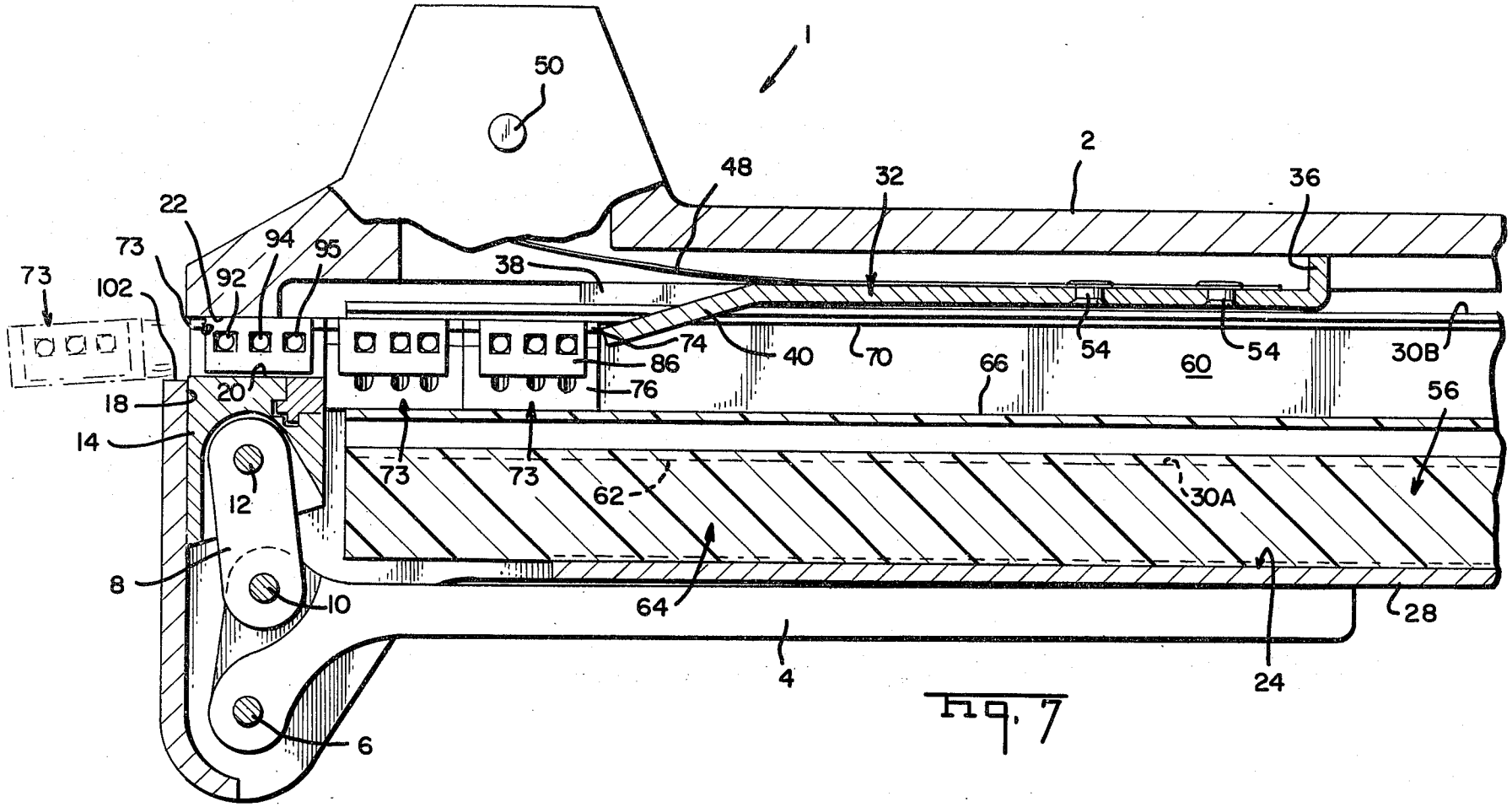
FIG. 7 is a view similar to FIG. 6 illustrating closure of a connector onto electrical wires, together with ejection of the closed connector, and the remainder of connectors being urged toward a work station of the tool by the thrust arm and ejector.

As shown in FIG. 6, a foremost one of the connectors 73 is positioned against the tool casing 18 which provides an impediment stop for each connector. The foremost connector 73 thereby is positioned at the work station and is located between the ram 14 and the anvil 22. Then, as shown in FIG. 1, an operator of the device will insert the ends of insulation covered wires 92, 94, and 95 within the corresponding openings of the foremost connector positioned at the work station. Subsequently the handle 4 is pivoted toward the handle 2, as shown in FIG. 7, so that the ram 14 is reciprocated toward the anvil 22, closing the foremost connector 73 onto the wires 92, 94, and 95. Additionally, the ram 14 will lift the closed connector 73, disengaging the same from the stop 18, thus aligning the closed connector with an ejector opening 108 provided in the tool casing in alignment with the work station. When the handle 4 is slightly pivoted so as to release the compression on the closed connector 73, the ejector and thrust arm 32 will impel the remainder of the connectors toward the work station, ejecting the closed connector outwardly of the tool through the opening 102. Ejection of the closed connector is shown in phantom outline. When the lever is returned to its original position, as shown in FIG. 6, another connector 73 will then be impelled by the ejector and thrust arm 32 into engagement on the stop 18, enabling repeated operation of the tool.

If the connector has not been sufficiently compressed or closed, the electrical connections with the inserted wires will be ineffectual. The opening is sized to pass only a connector which has been sufficiently closed and thereby reduced in height. Thus an insufficiently closed connector will not pass and therefore will not be ejected from the tool. The insufficiently closed connector will remain at the work station, enabling the tool operator to repeat reciprocation of the ram any number of times until the connector has been closed sufficiently to pass through the opening 102 and be ejected.

Figure 8:
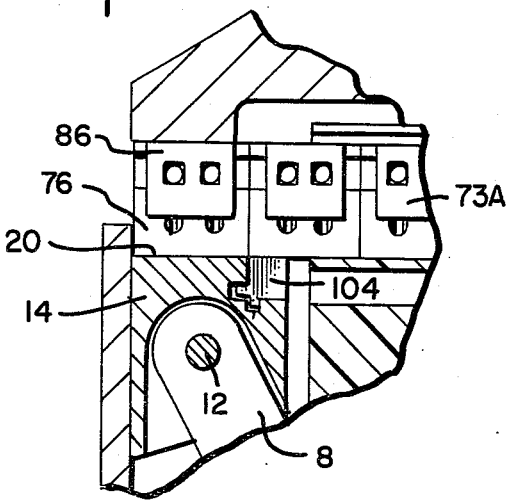
FIG. 8 is a fragmentary elevation in section of a ram and anvil portion of the tool, together with smaller sized connectors.

Thus far the tool operation has been described in conjunction with a three wire connector of a size which is complimentary with the size of the ram surface 20. As shown in FIG. 8, a smaller two wire connector may also be used in the tool. Since the two wire connector is of smaller size the ram 14 is adjustable in size to accommodate such a connector. More particularly, FIGS. 3 and 8 illustrate a slideable block portion 104 having rectangular projecting keys 106 and 108 which are integral with the block 104 and which are slideably received in corresponding grooved keyways of the ram 14. FIG. 3 illustrates the block 104 in alignment with the magazine chamber, which is in alignment with the work station of the tool, but offset to the left hand side of the ram surface 20. With the block in this position the ram surface 20 is of a size which accommodates the larger, three wire connector 73. Alternatively, the block 104 may be displaced or offset from its position shown in FIG. 3 to the right hand side of the ram surface 20. In this position, the left hand side of the ram will have a reduced surface area 20 which, as shown in FIG. 8, will accomodate in complementary fashion the surface size of a smaller, two wire connector 73A.

Although preferred embodiments of the present invention are disclosed and shown in detail, other modifications and embodiments which would be apparent to one having ordinary skill are intended to be covered by the spirit and scope of the claims.

I claim:

1. In a tool for serially feeding a plurality of connectors and connecting the same one at a time to electrical wires, the improvement comprising:

a casing;

a fixed anvil at one end of said casing;

a handle pivotally connected to said casing;

a ram slideably mounted in said casing and pivotally connected to said handle for reciprocation toward and away from said anvil;

a passageway within said casing and communicating with a work station defined between said anvil and said ram;

a thrust member slideably mounted on a first side wall of said casing for reciprocation along said passageway;

a spring for urging said thrust member along said passageway toward said work station;

a magazine slideably received in said passageway and so constructed and arranged for containing a plurality of connectors in serial arrangement;

means on said casing for positioning each connector in turn at said work station;

said magazine being aligned offset toward one side of said ram;

said ram having a moveable surface portion moveable into and out of alignment with said magazine for changing the size of said ram in correspondence with the size of connectors contained within said magazine.

2. In a tool for serially feeding a plurality of connectors and connecting the same to electrical wires, the combination comprising:

a casing;

an anvil at one end of said casing;

a handle pivoted to said casing;

a ram slideably mounted in said casing and pivotally connected to said handle for reciprocation toward and away from said anvil;

a passageway within said casing and communicating with a work station defined between said anvil and said ram;

a thrust member slideably mounted on a first side wall of said passageway for reciprocation along said passageway;

means for urging said thrust member along said passageway toward said work station;

a multiple chamber magazine slideably received in said passageway with a first of said chambers in alignment with said work station;

each of said chambers having an open side immediately adjacent an end wall, thereof;

said passageway having enclosure walls provided with grooves slideably receiving and aligning corresponding end walls of said chambers;

said thrust member straddling a corresponding end wall of said first chamber and entering said first chamber for urging connectors contained within said first chamber towards said work station.

3. The structure as recited in claim 2 wherein said thrust member includes a pair of depending fingers straddling a corresponding end wall of said first magazine chamber, one of said fingers entering an open side of said first chamber and traversible therealong to urge connectors contained in said first chamber toward said work station.

4. The structure as recited in claim 2, wherein said tool casing includes a portion adjacent said ram providing an impediment stop in alignment with said first magazine chamber, so that a connector urged outwardly of said first chamber engages said stop and is positioned at said work station in alignment with a compression applying surface of said ram.

5. The structure as recited in claim 4, wherein, said ram includes a size altering portion thereof moveable into and out of alignment with said first magazine chamber.

* * * * *